US006962298B1

(12) United States Patent
Martin

(10) Patent No.: US 6,962,298 B1
(45) Date of Patent: Nov. 8, 2005

(54) SHOWERHEAD

(76) Inventor: Kenneth L. Martin, 117 Woodbridge Way, Simpsonville, SC (US) 29681

( * ) Notice: Subject to any disclaimer, the term of this patent is extended or adjusted under 35 U.S.C. 154(b) by 846 days.

(21) Appl. No.: 09/710,535

(22) Filed: Nov. 9, 2000

(51) Int. Cl.[7] ..... A62C 31/00
(52) U.S. Cl. ..... 239/447; 239/124; 239/441; 239/443; 239/446; 239/449; 239/530
(58) Field of Search ..... 239/124, 436, 239/440, 441, 443, 444, 445, 446, 447, 448, 239/449, 581.1, 530

(56) References Cited

U.S. PATENT DOCUMENTS 3,963,179 A 6/1976 Tomaro
4,141,502 A 2/1979 Grohe
4,629,124 A * 12/1986 Gruber ..... 239/428.5
4,933,999 A 6/1990 Mikiya
5,845,851 A * 12/1998 Shfaram ..... 239/525
6,036,117 A * 3/2000 Heren et al. ..... 239/456
6,267,305 B1 * 7/2001 Kondo ..... 239/428.5
6,485,452 B1 * 11/2002 French et al. ..... 604/39

FOREIGN PATENT DOCUMENTS

GB 2306351 A * 5/1997 ..... A47K 3/22

* cited by examiner

*Primary Examiner*—Steven J. Ganey
(74) *Attorney, Agent, or Firm*—Technoprop Colton LLC

(57) ABSTRACT

Showerhead having suction cleansing facility, incisive pin-point massage and continuous flow shower spray in one hand-held apparatus.

19 Claims, 6 Drawing Sheets

SHOWERHEAD

BACKGROUND OF THE INVENTION

1. Field of the Invention

This invention relates generally to showerheads and relates more particularly to multi-mode showerheads with different settings for cleansing suction and continuous stream massage as well as one or more features generally useful in showerheads, such as a steady spray shower.

2. Prior Art

Prior art showerheads deliver a variety of streams from continuous sprays to pulsating delivery, from soft sprays to more incisive spray patterns, and many combinations thereof. The showerheads may be wall mounted or provided with a handle connected through a flexible hose to an incoming water supply.

A first example of a multi-mode showerhead is disclosed in U.S. Pat. No. 3,963,179 to Tomaro. The Tomaro '179 device is the more or less common combination showerhead comprising a steady stream spray shower with a pulsating stream massage. In the steady stream shower setting, the Tomaro '179 device provides a steady stream shower spray through peripheral holes. In the massage setting, the Tomaro '179 device provides a pulsating spray by way of a cutting vane that chops the water before it passes through inner holes.

A second example of a multi-mode showerhead is disclosed in U.S. Pat. No. 4,141,502 to Grohe. The Grohe '502 device also comprises a steady stream shower spray with a pulsating stream massage. However, in the massage setting, the Grohe '502 device provides a rotating massage by deflecting the water spray continuously about a circular array of nozzles or holes.

A third example of a multi-mode showerhead is disclosed in U.S. Pat. No. 4,933,999 to Mikiya et al. The Mikiya '999 device comprises a steady stream spray shower with a water/air jet stream massage. In the jet stream massage setting, the Mikiya '999 device provides a mixture of water and air jetted as a strong stream through a central hole or nozzle.

For the majority of users, different ones of the foregoing types of showerheads have proven to be enjoyable and beneficial. However, one benefit that the foregoing showerheads do not offer is the ability to deep cleanse the skin, going beyond the mere application of water on the surface of the skin. Facial cleansing is a common use of daily deep cleansing. Surface cleansers and light exfoliating chemical cleansers are available on the cosmetic market for this purpose. However, these cleansers are not always very effective in removing oil and debris from the pores of the skin without also causing adverse reactions such as dryness or redness from chemical application. Likewise, it can be cost prohibitive to apply chemical cleansers daily and/or on large portions of the body, including the neck, shoulders, chest and back areas where many people produce excess oil. One method of removing makeup, body oils, cleansers and the like from the skin is to use a suction-creating device. Thus, there is a need for a showerhead that allows one to cleanse the skin using suction without the potential damage and expense of chemicals.

Another shortcoming of the many showerheads offered on today's market is the lack of a single concentrated stream of water that can provide constant, firm pressure at a selected point on the body. Many showerheads offer incisive sprays but generally in a dispersed pattern, either in a central spray area or along the outer surface of the showerhead or some combination of the two. Showerheads are available that provide fast and slow pulsating delivery but do not concentrate the full pressure of the water in one location so that relief is provided to tight muscles. Showerheads also are available that provide a combination air and water jet massage, which generally is not as powerful or concentrated in area as a jet massage using only water. This pinpoint type of massage is well known as a method of massage that can relieve stiff necks, muscle kinks and other muscular pains, which benefit from single point focus. Therefore, a need exists for a showerhead that will provide water flow in a concentrated area.

Thus, it can be seen that there is a need for a multi-mode showerhead that can provide a typical steady spray shower in combination with a water-only jet pinpoint massage spray and/or a suction device or means. It is to the provision of such a showerhead that the present invention is primarily directed.

BRIEF SUMMARY OF THE INVENTION

The preferred embodiment of the present invention is a hand-held showerhead that offers three modes: cleansing suction, concentrated single-point water massage, and typical all-continuous spray. Water entering the device is directed through one of various water flow paths through the device to exit orifices. The specific path the water flow will follow is defined by a flow director or flow valve directing the incoming water to the selected orifice or orifices in the device as defined by the different modes. Selection of the specific water flow path is achieved by actuating the flow valve via a control mechanism. User access for mode selection is by way of an external circumferential selector cap or dial operably coupled to the control mechanism through a control arm.

The showerhead is provided with a generally cylindrical hollow handle connected through a flexible hose to an incoming water supply. The generally cylindrical handle can have finger depressions along the length of the external handle surface to enhance ease of handling in the shower. Water entering the device travels through the hollow center of the handle and encounters the flow valve. The flow valve can be set in one of three modes: spray shower, water jet massage, or suction.

A selector cap is provided to set the flow valve to the desired mode. A display ring with graphic symbols corresponding to the above modes is mounted adjacent to the selector cap, or the graphic symbols can be placed directly on the selector cap. When the selector cap is set for shower, the flow valve permits water flow through one or more, and preferably two, ports that feed the water into a spray head creating an all-continuous spray. When the selector cap is set for massage, the flow valve isolates the water flow through a central port to a central nozzle only, resulting in a concentrated jet stream of water through a central nozzle with no outlet flow from the continuous spray head. When the selector cap is set for suction, the flow valve creates a flow configuration that directs all incoming water through a center inlet port and out of the suction outlet. This configuration prevents water from flowing out of continuous spray head or the central massage nozzle, only allowing the water flow to exit the suction outlet on the back of the device, and creates a suction through the central massage nozzle, which suctions debris and oil from the skin into the exiting flow of water.

Thus, it is an object of the present invention to provide a multi-mode showerhead that comprises either a conventional shower spray and a water jet massage, a conventional shower spray and a suction, a conventional shower spray and a water jet massage and a suction, or a water jet spray and a suction, in one device.

It is another object of the present invention to provide a showerhead that removes debris and oils from the skin by suction and without the need for chemical cleansers.

It is another object of the present invention to provide a showerhead that allows for concentrated water flow to selected parts of the body requiring single point massage.

It is another object of the present invention to provide a showerhead allowing for interchangeable spray modes that insure that all cleansing needs are met.

It is another object of the present invention to provide a handheld multi-mode showerhead that is easy and convenient to use.

It is another object of the present invention to provide a handheld multi-mode showerhead that is simple in design, rugged in construction, and economical to manufacture.

These objects, and other objects, features and advantages of the invention, will become more apparent to one skilled in the art when the following detailed description of the preferred embodiments is read in conjunction with the appended drawings in which like reference numerals designate like parts throughout the several views.

DETAILED DESCRIPTION OF THE PREFERRED EMBODIMENTS

The present invention is a showerhead that allows a user to select from suction skin cleansing, pinpoint water jet massage and continuous spray modes in the convenience of a hand-held showerhead. The desired mode is selected with the turn of a dial and allows the user to enjoy all three functions at their fingertips. The showerhead generally comprises handle, flow control assembly and selector mechanism.

Figure 1:
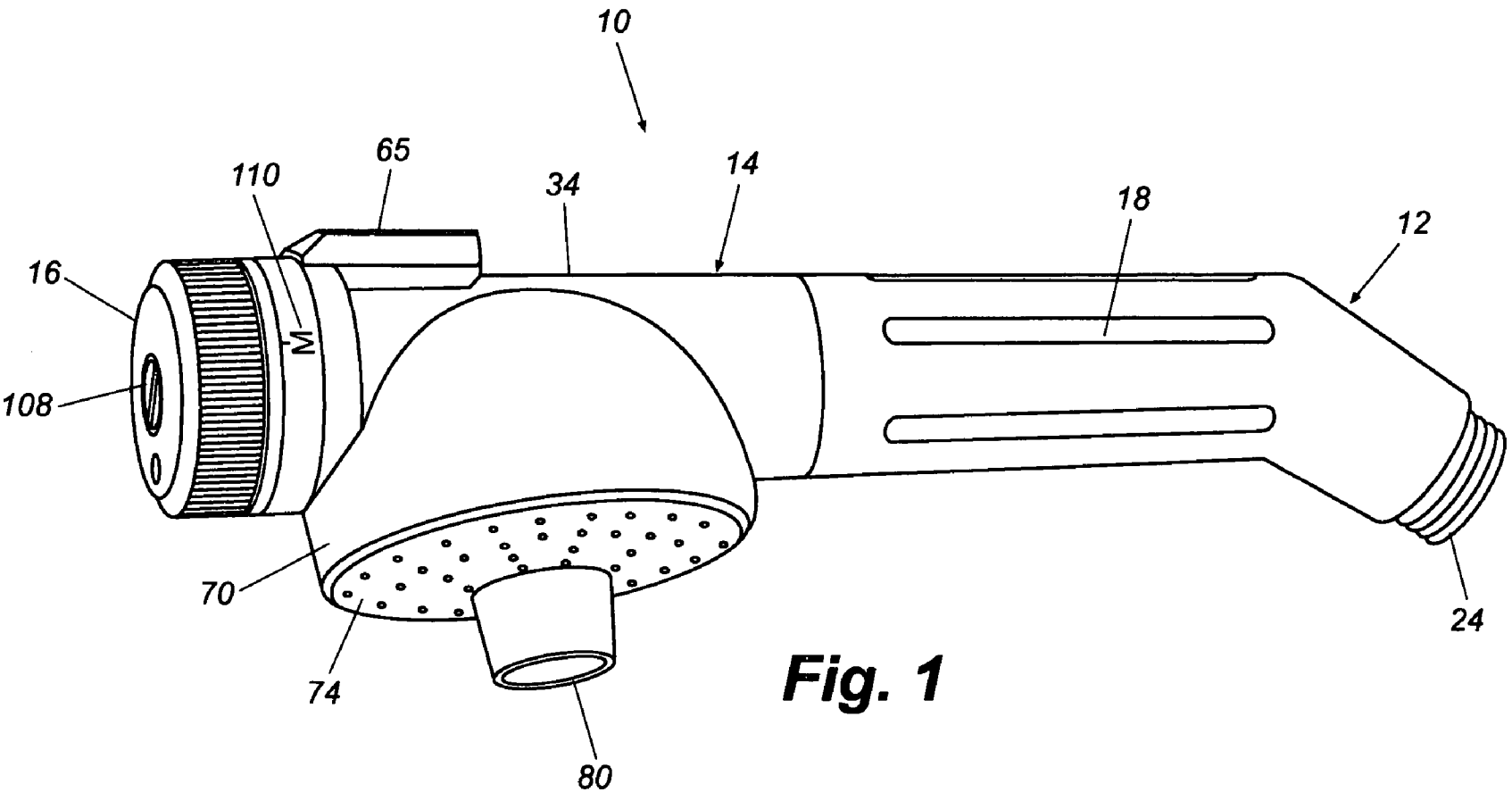
FIG. 1 shows a perspective view of the showerhead of the present according to a preferred embodiment.

FIG. 1 shows a showerhead 10 according to the present invention adapted for attachment to the end of a flexible hose (not shown) for hand-held use by means of hollow handle 20 at handle inlet 24. Flexible hose attaches to a water supply such as, for example, the threaded water pipe in a conventional shower stall. The flow control assembly section 14 of showerhead 10 comprises three outlets: a central nozzle 80 for delivering a water jet stream in a first mode and for creating suction in a second mode, a peripheral group of discharge outlets 76 for delivering a continuous shower spray, and a suction outlet baffle 65. The selector mechanism section 16 comprises a manually operated rotary function selector control cap 92 that enables the water flow to be adjustably distributed amongst the flow paths leading to the three types of outlets. The handle 20, flow control section 14 and selector mechanism section 16 can suitably be constructed of metal, plastic material or any other material suitable for use in a bathroom setting.

Figure 2:
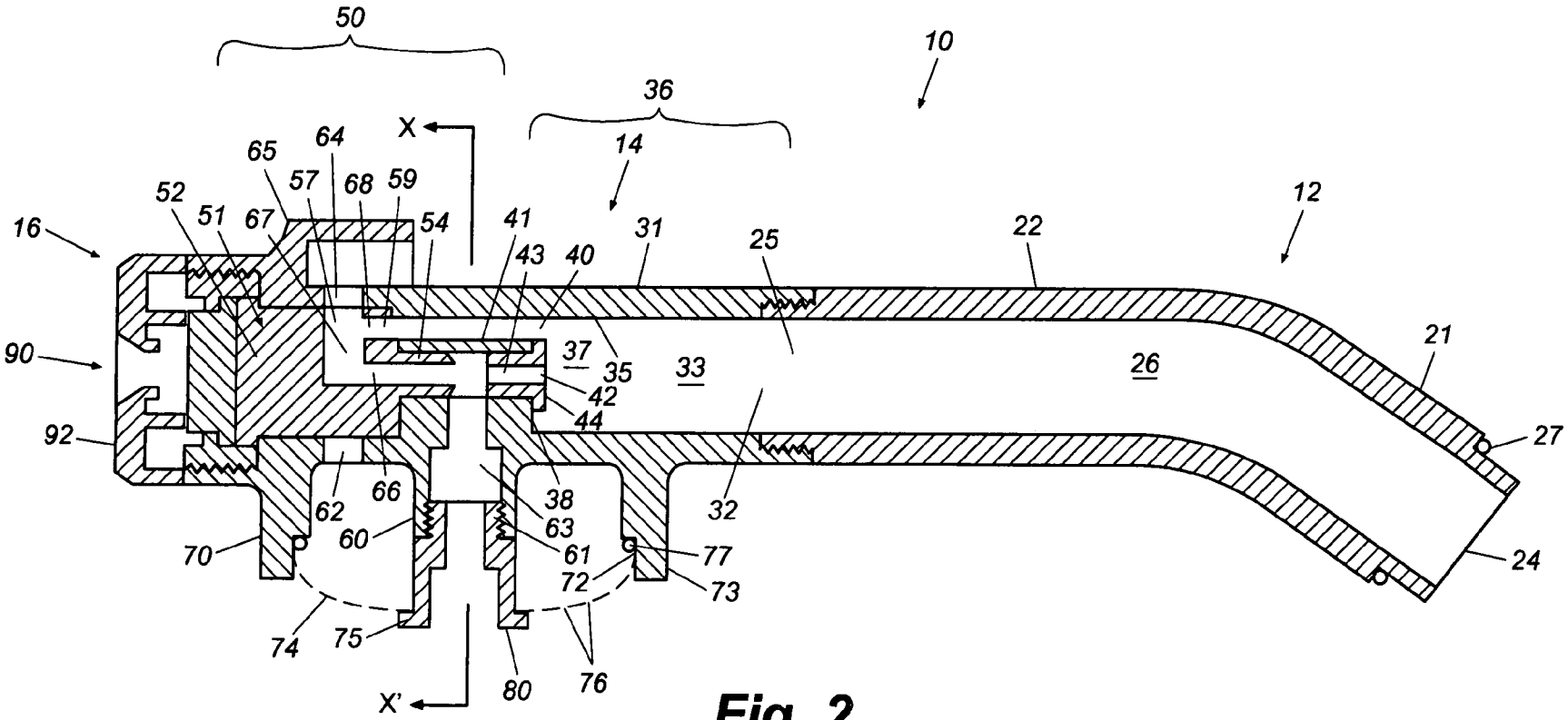
FIG. 2 shows a sectional side view of the showerhead shown in FIG. 1.

Referring now to FIGS. 1 and 2, generally cylindrical handle 20 is connected to flexible hose, which in is turn, connected to a water supply line. Handle 20 is hollow with handle bore 26 running along the entire internal length of handle 20. Handle inlet 24 is connected to flexible hose by conventional threads, twist and lock mechanisms, or friction, with sealing provided by O-ring 27 or the like. Handle outlet 25 of handle 20 is connected to control inlet 32 of flow control assembly section 14 as more fully described below.

Handle 20 can have finger depressions 18 along the length of the handle surface to improve manual dexterity when handling the wet showerhead 10. To further improve ease of handling, first portion 21 of handle 20 can be angled relative to second portion 22 in order to position flexible hose away from the user's body. It has been found that an angle of approximately 35° between handle 20 and flow control assembly section 14 allows the showerhead 10 to be mounted on the wall of the shower stall and provide an appropriately angled spray. Alternatively, handle 20 can be straight, curved, or any other functionally or aesthetically pleasing shape so long as the shape allows a fluid connection between water supply line and flow control assembly section 14.

Flow control assembly section 14 comprises a generally cylindrical housing 34 and a circular shaped spray cup 70 integrally attached to housing 34, preferably at approximately a 90° angle to the centerline of housing 34. Housing 34 and spray cup 70 are suitably constructed of metal, rigid plastic or any other material suitable for use in a bathroom setting.

Figure 9:
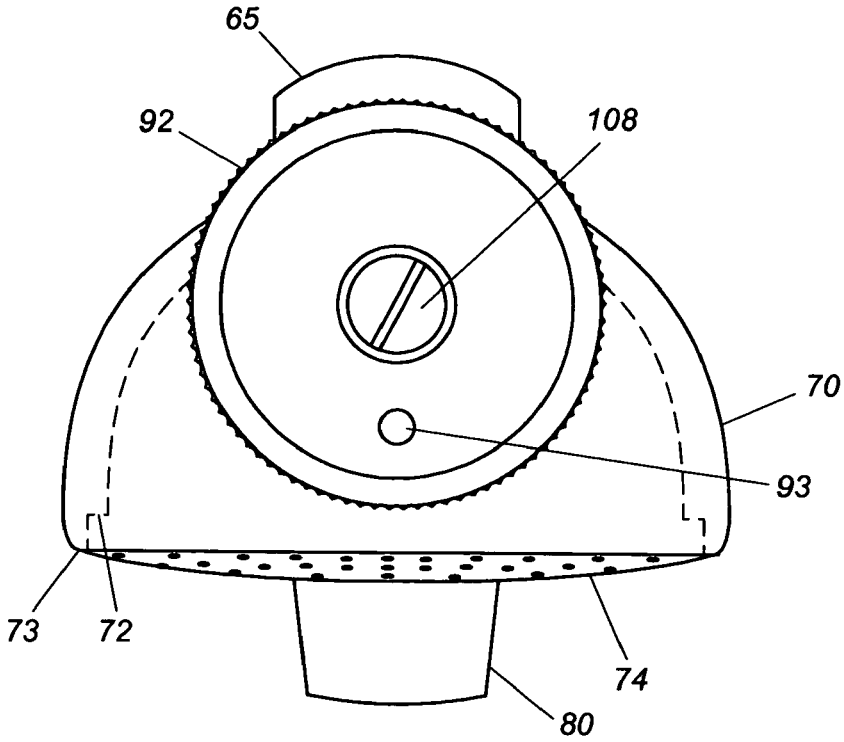
FIG. 9 shows a top view of the showerhead shown n FIG. 2 with wall thicknesses shown in ghost lines.
Figure 10:
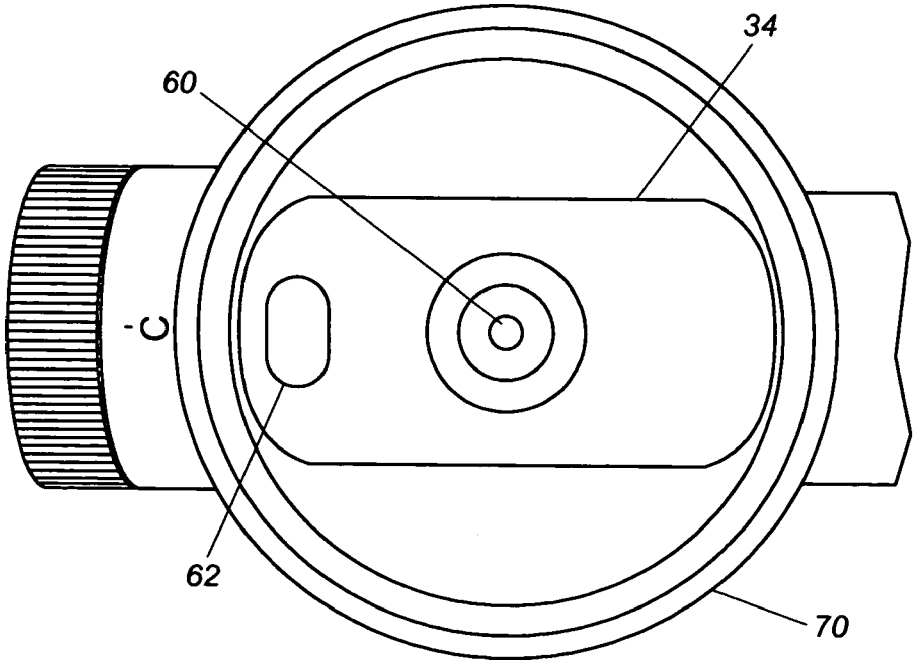
FIG. 10 shows a front view of the spray cup of the showerhead shown in FIG. 2 with the spray ring removed.

As can be seen in greater detail in FIGS. 9 and 10, spray cup 70 preferably is a generally circular cup shape comprising inner lip 72 recessed along an outer rim 73 of spray cup 70. Spray ring 74 is attached to spray cup 70 and generally comprises an annular ring defining a center aperture 75. The center aperture 75 is dimensioned to receive central nozzle 80 as more specifically described below. The spray ring 74 also contains a plurality of discharge outlets 76 arranged radially from center aperture to outer edge of ring. The inner lip 72 on the spray cup 70 is dimensioned to receive the spray ring 74 with sealing provided by a sealing ring 77, such as an o-ring. Spray ring 74 may be constructed of plastic or metal suitable for water use. Spray ring 74 may be frictionally attached to spray cup 70, or attached by other means such as small screws extending through spray ring 74 and being anchored in spray cup 70, or by cooperating threads on spray ring 74 and spray cup 70.

As can be seen in greater detail in FIGS. 2 and 10, housing 34 is a generally cylindrical structure comprising an outer wall 31 and an interior bore 33 extending throughout the length of housing 34. Interior bore 33 comprises inlet chamber 37 and valve chamber 51, separated from each other by integral wall 38 located generally midway along the length of interior bore 33. Inlet chamber 37 is a generally cylindrical bore terminating at one end at the integral wall 38 the other end being open to and attached to handle outlet 25.

Opening into valve chamber 51 on the opposite side thereof from handle outlet 25 are upper inlet port 40 formed by an orifice extending through the integral wall 38 and central inlet port 42 formed by an orifice also extending through the integral wall 38 so that upper inlet port 40 and central inlet port 42 extend through the integral wall 38 and into valve chamber 51, allowing fluid communication between inlet chamber 37 and valve chamber 51. The central inlet 42 preferably forms a central bore 43 through integral wall 38 extending from inlet chamber 37 to valve chamber 51. Central bore 43 is coaxial with inner bore 33.

Central inlet port 42 further comprises an elongated cylindrical wall 41 surrounding central bore 43. Elongated wall 41 is coaxial with bore 43 and interior bore 33 and extends a certain distance within both inlet chamber 37 and valve chamber 51. Central inlet port 42 can be partly occluded by reducer 44 frictionally attached within central bore 43.

Valve chamber 51 also terminates at one end at integral wall 38 with the other end being closed by selector mechanism section 16. Opening out of and extending through outer wall 31 are spray cup outlet port 62 and suction outlet port 64, with spray cup outlet port 62 preferably being diametrically opposite suction outlet port 64. Spray cup outlet port 62 allows fluid communication between valve chamber 51 and the interior of spray cup 70, as disclosed in more detail below. Suction outlet port 64 allows fluid communication with the ambient through suction outlet baffle 65, as disclosed in more detail below.

Extending outward from outer wall 31 is central nozzle outlet 60, which is a generally cylindrical structure having an axis preferably perpendicular to the axis of housing 34. Central nozzle outlet 60 preferably is located approximately midway along the length of housing 34, being located in approximately the same central position along the exterior of housing 34 as the integral wall 38 is located within the interior of housing 34. Extending through the center of central nozzle outlet 60 is central nozzle outlet port 63, which allows fluid communication between central inlet port 42 and central nozzle 80. Central nozzle outlet port 63 extends through the elongated wall 41 and housing 34 body thicknesses and into the central nozzle 80. Integral to central nozzle outlet 60 is central nozzle coupling 61, which preferably comprise female threads complementary to male threads on central nozzle 80.

Mounted for rotation within the valve chamber 51 is flow valve 52. As shown particularly in FIGS. 3–7, flow valve 52 is a generally cylindrical shaped body with valve stem 54 and sealing rim 56. Various flow paths are defined through flow valve 52, as disclosed in more detail below. Valve stem 54 also is a generally cylindrical structure integrally attached on the proximal end of the flow valve 52, and sharing the same central axis as flow valve 52. The distal end of valve stem 54 tapers inward forming a frusto-conical structure.

Stem inlet 58 is a flow inlet formed on the distal end of valve stem 54 by an aperture in valve stem 54 and allows water to flow into a primary central flow bore 66 within flow valve 52. Stem inlet 58 is in substantial axial alignment with central inlet port 42. Upper valve inlet 59 is a secondary flow inlet formed by an aperture radially located on flat circular face of flow valve 52 and allows water to flow into a secondary peripheral flow bore 68 within flow valve 52. Upper valve inlet 59 can be placed in substantial axial alignment with upper inlet port 40 when flow valve 52 is positioned in the spray shower setting as more fully disclosed below. Central flow bore 66 and peripheral flow bore 68 extend partly through flow valve 52 until they encounter perpendicular flow bore 67, which has an axis generally perpendicular to at least central flow bore 66. Perpendicular flow bore exits flow valve 52 through valve outlet 57, thus allowing fluid communication between stem inlet 58 and valve outlet 57 and between upper valve inlet 59 and valve outlet 57. Preferably, peripheral flow bore 68 and central flow bore 66 are parallel to each other. However, it is contemplated that peripheral flow bore 68 can be angled inward relative to central flow bore 66 such that peripheral flow bore 68 and central flow bore 66 meet at perpendicular flow bore 67.

Stem inlet 58 extends into central bore 43 of central inlet port 42 and is in close proximity to reducer 44, allowing water to flow into central flow bore 66 and into central nozzle outlet port 63. Stem inlet 58 preferably always is open to receive fluid flow from central inlet port 42. Upper valve inlet 59 can be positioned to be opposite from and cooperate with upper inlet port 40, allowing water to flow into peripheral flow bore 68, or can be positioned to prevent flow into peripheral flow bore 68. Valve outlet 57 can be positioned to be opposite from and cooperate with spray cup outlet port 62, allowing water to flow into spray cup 70, or can be positioned to be opposite suction outlet port 64, allowing water to flow into suction baffle 65, or can be positioned to prevent water flow out of perpendicular flow bore 67.

Figure 3:
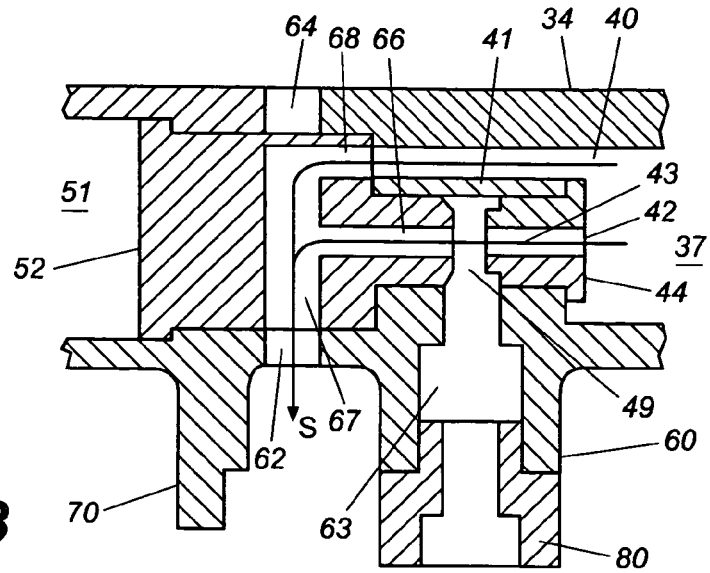
FIG. 3 shows a sectional side view of the water flow path of the showerhead shown in FIG. 2 in the shower position.

FIG. 3 shows a first flow path S of water through the showerhead for a spread spray shower. This first flow path S is formed when the selector control mechanism 90 is rotated so that upper valve inlet 59 is aligned with upper inlet port 40 and valve outlet 57 is aligned with spray cup outlet port 62. In this flow path, a first portion of the water entering inlet chamber 37 flows through central inlet 42 into valve inlet 58, and through central flow bore 66 to perpendicular flow bore 67, and a second portion of the water entering inlet chamber 37 flows through upper inlet port 40 into upper valve inlet 59, and through peripheral flow bore 68 to perpendicular flow bore 67. The two flows of water combine in perpendicular flow bore 67, exit the flow valve 52 through valve outlet 57 and enter spray cup 70 through spray cup outlet 62. Water also can enter central nozzle 80 via nozzle outlet 60. Fluid flow along this path emerges primarily as spray from discharge outlets 76 on spray ring 74 and possibly secondarily as a single additional stream form central nozzle 80.

The use of both central flow bore 66 and peripheral flow bore 68 in the spray shower mode allows a greater flow of water through flow valve 52 into spray cup 70, providing for at least an adequate amount and pressure of water for a comfortable spray shower. Water of sufficient quantity and pressure flowing into spray cup 70 fills spray cup 70 allowing water to emerge from spray cup 70 through all or at least a satisfactory number of discharge outlets 76. It is possible to structure flow valve to use only central flow bore 66 or only peripheral flow bore 68 if a sufficient quantity and/or pressure of water is provided to the device 10. Likewise, flow valve 52 can be structured to have additional peripheral flow bores to increase the flow of water through the device 10.

Figure 4:
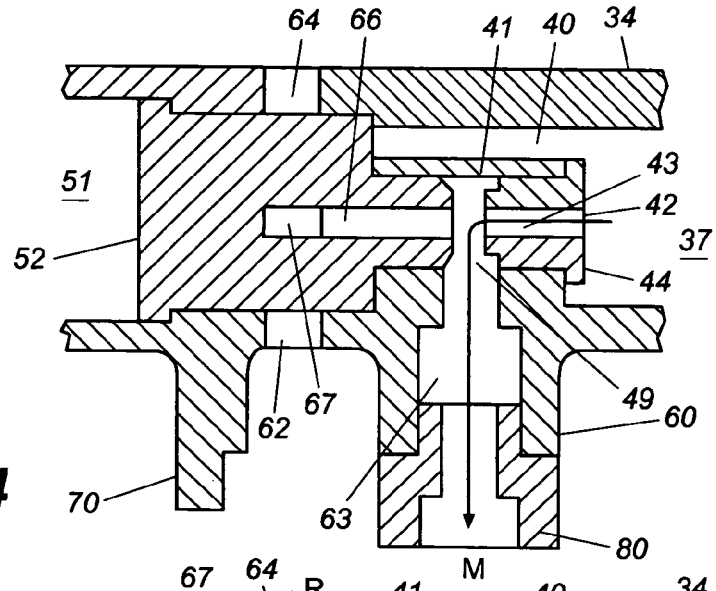
FIG. 4 shows a sectional side view of the water flow path of the showerhead shown in FIG. 2 in the massage position.

FIG. 4 shows a second flow path M of water through the showerhead 10 for a jet stream water massage. The second flow path M is formed when the selector control mechanism 90 is rotated so that flow valve 52 is positioned so that upper valve inlet 59 does not align with upper inlet port 40 and valve outlet 57 does not align with spray cup outlet 62 or suction outlet 64. In this flow path, water entering inlet chamber 37 may flow into central flow bore 66, but is prevented from leaving flow valve 52 because valve outlet 57 is aligned with a solid wall, namely the interior surface of valve chamber 51. In this position, water flowing into inlet chamber 37 is concentrated into central inlet port 42, flows through central nozzle outlet port 63, and emerges as an incisive stream from central nozzle 80. No fluid flow emerges from spray ring discharge outlets 76 or suction outlet 64.

In this mode, water flows only through central bore 43, and not through any additional flow bores as in the spray shower mode. The quantity of water allowed through only central bore 43 into central nozzle 80 is sufficient to provide the single incisive water jet spray. The pressure and/or diameter of the water spray can be increased or decreased by using central nozzles 80 with smaller or larger bores. Such interchangeable nozzles 80 are contemplated.

Figure 5:
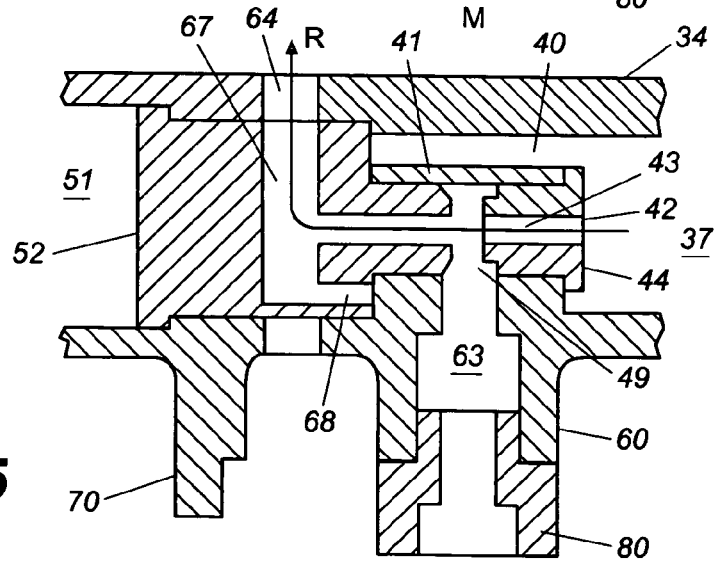
FIG. 5 shows a sectional side view of the water flow path of the showerhead shown in FIG. 2 in the cosmetic position.
Figure 6:
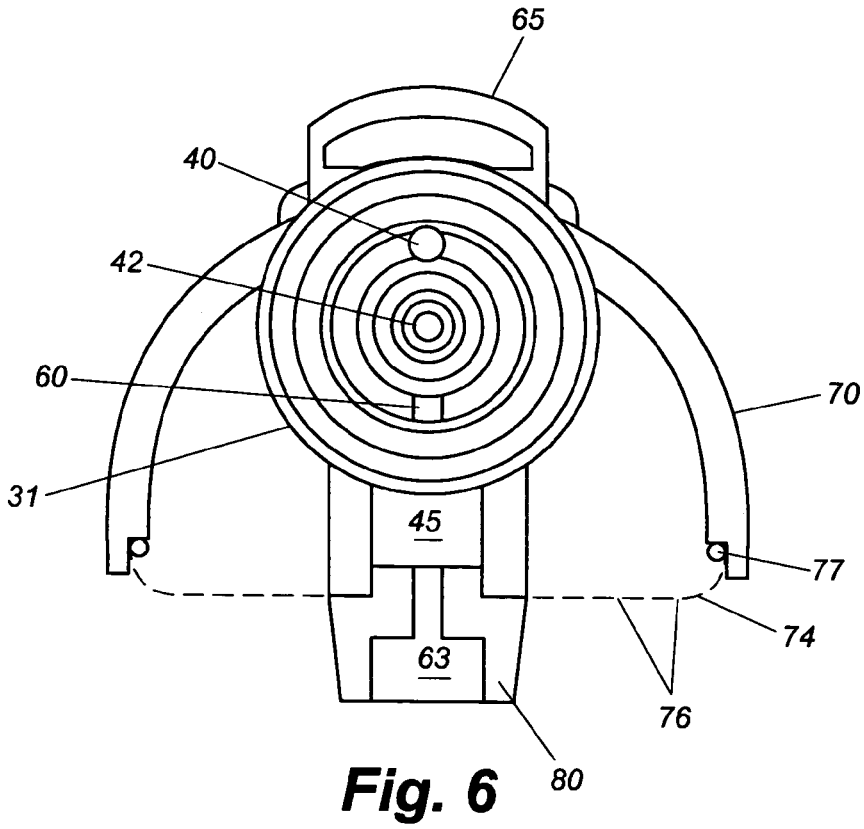
FIG. 6 shows a sectional view along X–X' of the showerhead shown in FIG. 2.
Figure 7:
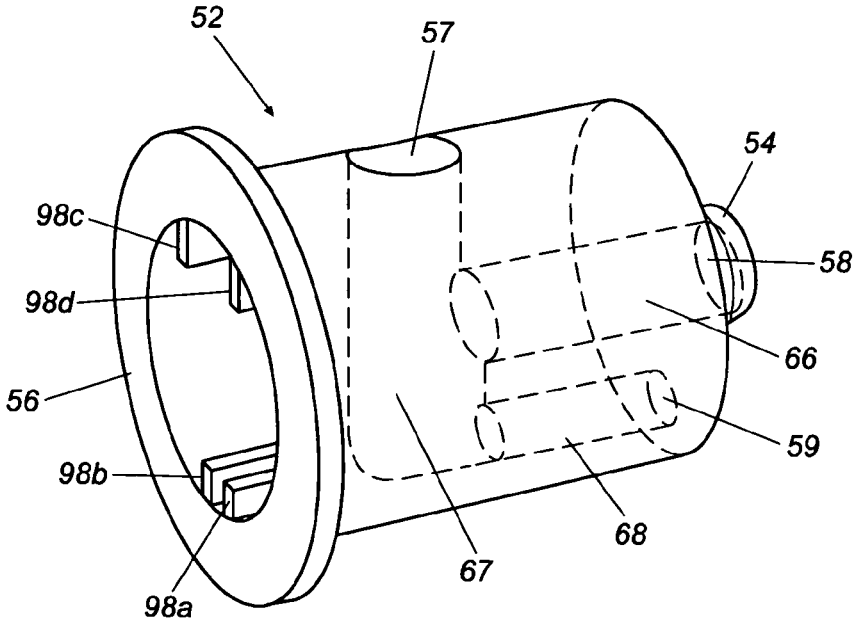
FIG. 7 shows a perspective view of the flow valve with flow paths shown in ghost lines.

FIG. 5 shows a third flow path R of water through the showerhead 10 for a cleansing suction. The third flow path R is formed when the selector control mechanism 90 is rotated so that flow valve 52 is positioned so that upper valve inlet 59 does not align with upper inlet port 40 and valve outlet 57 is aligned with suction outlet 64. In this flow path, water flowing into inlet chamber 37 is concentrated through central inlet 42 and flows into valve inlet 58, through central flow bore 66 to perpendicular flow bore 67, into perpendicular flow bore 67, exits the flow valve 52 through valve outlet 57, and emerges from suction outlet 64. The water is directed out of the device 10 via suction baffle 65. No fluid emerges from spray ring outlets 76 or from the central nozzle 80. A negative pressure is created within the interior volume of central nozzle outlet port 63 (between central inlet port 42, stem inlet 58 and central nozzle 80) when the water bypasses the generally smaller diameter of the entrance 49 to nozzle 60 for the generally larger diameter of the stem inlet 58. Further, as water tends to flow in a straight path, the water entering bore interior 33 is more likely to continue on a straight flow path into central flow bore 66 rather that making the approximately 90° turn into central nozzle outlet port 63. The negative pressure created causes a suction action from the ambient into central nozzle 80, and into the water flow from inlet chamber 37 to central flow bore 66. Thus, when the central nozzle 80 is placed on the skin of the user, such things as water, make up, oils and/or debris are removed from the skin in a cleansing suction.

In this mode, water flows only through central bore 43, and not through any additional flow bores as in the spray shower mode. The quantity of water allowed through only central bore 43 into central flow bore 66 is sufficient to create the negative pressure needed to provide a comfortable cleansing suction. The negative pressure can be increased or decreased by using central nozzles 80 with smaller or larger bores, respectively. Suction baffle 65 is optional and is provided to prevent water from emerging from the device at a 90° angle. Suction baffle preferably directs the emerging water flow down along the length of housing 34 and handle 20.

Hence, it can be seen that flow into upper valve inlet 59 can occur only when upper inlet port 40 and upper valve inlet 59 are aligned therewith, and is blocked when a portion of flow valve 52 is aligned therewith. It also can be seen that flow from suction outlet 64 can occur only when suction outlet 64 and valve outlet 57 are aligned therewith and is blocked when a portion of flow valve 52 is aligned therewith. Further, it also can be seen that flow from spray cup outlet 62 can occur only when spray cup outlet 64 and valve outlet 57 are aligned and is blocked when a portion of flow valve 52 is aligned with the spray cup outlet 64.

Figure 8:
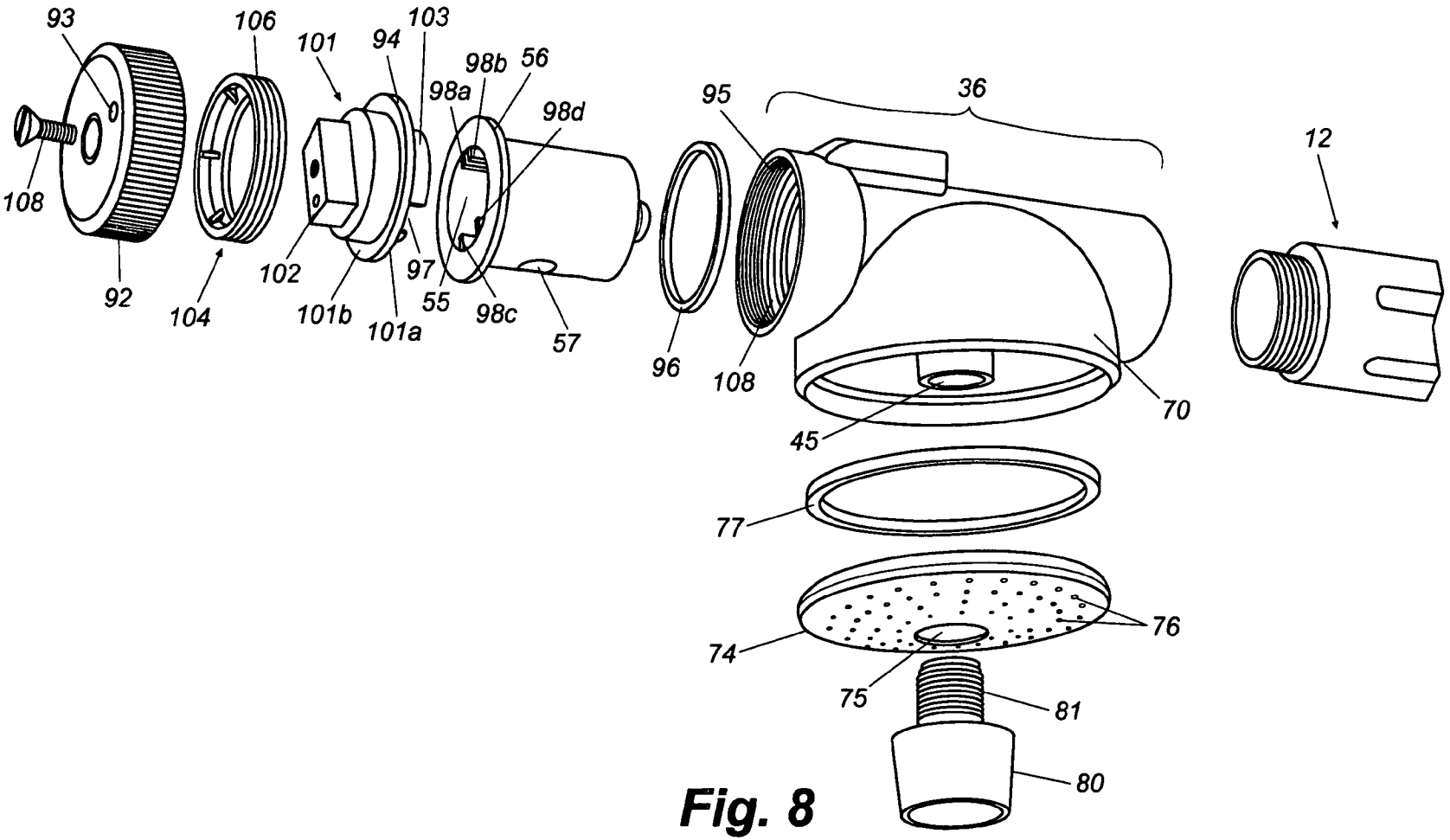
FIG. 8 shows an exploded view of the showerhead shown in FIG. 1.

As shown in FIG. 8, valve positioning is controlled by the manually operable rotary function selector control cap 92, which is in mechanical communication with valve cap 94, which in turn is in mechanical communication with flow valve 52. Valve cap 94 cooperates with flow valve 52 on the opposite end thereof from the valve stem 54. Valve cap 94 seats onto inner lip 95 formed circumferentially along the interior of outer wall 31 at opposite end thereof from handle outlet 25 and proximal to selector control cap 92. Sealing is provided by an o-ring 96 placed between valve cap 94 and inner lip 95. Protruding from internal wall of flow valve 52 are fins 98*a*, 98*b*, 98*c* and 98*d*.

Control plate 101 comprises first side 101*a* and second side 101*b*, with notched collar 103 extending from first side 101*a* and rectangular control arm 102 extending from second side 101*b*. Collar 103 is dimensioned to fit into a hollow recess 55 in flow valve 52 with notches 97 dimensioned to receive fins 98*a*, 98*b*, 98*c* and 98*d*. Control plate 101 is secured by retaining ring 104, which attaches to the interior of outer wall 31 at inner lip 95, preferably by threads 106 integrally formed onto the outside circumference of retaining ring 104, and cooperating with threads 108 integrally formed into the internal circumference of the showerhead housing 34. Selector control cap 92 is dimensioned to receive control arm 102 extending from control plate 101 and is secured to control plate 101 preferably with screw 108 or other suitable attachment means.

Housing 34 can incorporate a labeling strip 110 or other positioning identification means secured to housing 34. Labeling strip 110 or other positioning means assists the user in determining the mode the device is in and in selecting the desired mode. Selector control cap 92 also comprises indicator 112 that cooperates with labeling strip 110 or other positioning means to indicate a selected mode.

In use, water enters the device 10 through the interior handle bore 26 of handle 20 via handle inlet 25 and is directed into any of three flow paths as shown in FIGS. 3 to 5. In a first flow path S, designated as shower mode on selector control cap 92, flow valve 52 is correspondingly positioned to align upper inlet port 40 with upper valve inlet 59 and valve outlet 57 with spray cup outlet 62. In this mode, water enters the flow valve 52 through stem inlet 58 and upper inlet 59, emerges from the flow valve 52 through valve outlet 57 into spray cup 70, and emerges from the device 10 primarily through spray discharge outlets 76 and possibly secondarily through central nozzle 80.

A second flow path M, controllable by selector control cap 92 and designated as massage mode, prevents water from flowing through flow valve 52 and channels water flow through and out of central nozzle 80 to produce a concentrated stream.

A third flow path R, controllable by selector control cap 92 and designated as cosmetic mode, channels water flow into central flow bore 66 of flow valve 52 through stem inlet 58, through valve outlet 57, and out suction outlet port 64 and suction baffle 65 to produce a negative pressure within the device 10, specifically through central nozzle 80, by which water, make up, oil and/or debris are removed from the user's skin.

Although the present invention has been described with reference to preferred embodiments thereof, it is to be understood that these embodiments are for illustrative purposes and should not be construed as limitations on the scope of the invention. Accordingly, the spirit and scope of the present invention should not be determined by the embodiments illustrated, but by the claims appended hereto and their legal equivalents.

What is claimed is:

1. A multi-mode showerhead comprising:

a housing having a valve chamber therein, a water inlet and a plurality of water outlets;

a flow valve located in said valve chamber, said flow valve being rotatable into a plurality of rotative positions;

a spray ring for forming a spray shower; and a central nozzle that serves as a spray nozzle for forming a steady unitary stream of water and as a suction nozzle for creating a negative pressure through said suction nozzle;

whereby said showerhead provides the spray shower when said flow valve is rotated to a first of said plurality of rotative positions, a the steady unitary stream of water when said flow valve is rotated to a second of said plurality of rotative positions, and the suction action when said flow valve is rotated to a third of said plurality of rotative positions, wherein when said flow valve is rotated to said third of said plurality of rotative positions, the water passes out of the showerhead only though a suction outlet baffle and not through said spray ring and said spray nozzle.

2. The showerhead as characterized in claim 1, wherein said flow valve comprises a flow bore therethrough, said flow bore comprising a flow inlet and a flow outlet, whereby when said flow valve is rotated to said first of said plurality of rotative positions, said first flow inlet is in fluid communication with said water inlet and said flow outlet is in fluid communication with a first of said plurality of water outlets; when said flow valve is rotated to said second of said plurality of rotative positions, said flow inlet is in fluid communication with a second of said plurality of water outlets; and when said flow valve is rotated to said third of said plurality of rotative positions, said flow inlet is in fluid communication with said water inlet and said flow outlet is in fluid communication only with a third of said plurality of water outlets.

3. The showerhead as characterized in claim 2, further comprising a spray cup and a spray ring covering said spray cup, said spray cup having an internal volume for collecting, containing and generally evenly dispersing water, and said spray ring comprising a plurality of openings through which water is dispersed from said spray cup forming the spray shower when said flow valve is rotated to said first of said plurality of rotative positions.

4. The showerhead as characterized in claim 2, further comprising a spray nozzle through which water is dispersed forming the steady unitary stream of water when said flow valve is rotated to said second of said plurality of rotative positions.

5. The showerhead as characterized in claim 2, further comprising a suction nozzle by which water is passed creating a negative pressure through said suction nozzle creating the suction action when said flow valve is rotated to said third of said plurality of rotative positions.

6. The showerhead as characterized in claim 4, wherein said spray nozzle is releasably attached to said showerhead.

7. The showerhead as characterized in claim 2, wherein said flow bore further comprises a secondary flow inlet, said flow inlet being in fluid communication with a primary flow bore within said flow valve, said secondary flow inlet being in fluid communication with a secondary flow bore within said flow valve, and said primary flow bore and said secondary flow bore converging within said flow valve upstream from said flow outlet, whereby water can enter said flow valve through said flow inlet and said secondary flow inlet and can exit said flow valve through said flow outlet, creating a greater flow of water through said flow valve.

8. The showerhead as characterized in claim 7, wherein water can flow into said secondary flow inlet only when said flow valve is rotated to said first of said plurality of rotative positions.

9. The showerhead as characterized in claim 1, further comprising a handle, wherein said handle comprises a first portion and a second portion, said first portion being attached to said housing and having a first longitudinal axis and said second portion having a second longitudinal axis that is an angle relative to said first longitudinal axis.

10. The showerhead as characterized in claim 1, further comprising a handle attached to said housing, wherein said handle comprises depressions defining grips.

11. The showerhead as characterized in claim 1, wherein said showerhead is formed of a material suitable for use in a wet environment.

12. The showerhead as characterized in claim 1, wherein said showerhead is formed of a material suitable for use in a showerbath.

13. A multi-mode showerhead comprising:

a housing having a valve chamber therein, a water inlet and at least one water outlet; and a flow valve located in said valve chamber, said flow valve being rotatable into a plurality of rotative positions, and said flow valve comprising a flow bore therethrough, said flow bore comprising a flow inlet and a flow outlet;

whereby said showerhead provides a spray shower when said flow valve is rotated to a first of said plurality of rotative positions and a suction action when said flow valve is rotated to a second of said plurality of rotative positions, and whereby when said flow valve is rotated to said first of said plurality of rotative positions, said first flow inlet is in fluid communication with said water inlet and said flow outlet is in fluid communication with a first of said plurality of water outlets; and when said flow valve is rotated to said second of said plurality of rotative positions, said flow inlet is in fluid communication with said water inlet and said flow outlet is in fluid communication only with a second of said plurality of water outlets.

14. The showerhead as characterized in claim 13, further comprising a spray cup and a spray ring covering said spray cup, said spray cup having an internal volume for collecting, containing and generally evenly dispersing water, and said spray ring comprising a plurality of openings through which water is dispersed from said spray cup forming the spray shower when said flow valve is rotated to said first of said plurality of rotative positions.

15. The showerhead as characterized in claim 14, further comprising a suction nozzle by which water is passed creating a negative pressure through said suction nozzle creating the suction action when said flow valve is rotated to said second of said plurality of rotative positions, wherein when said flow valve is rotated to said second of said plurality of rotative positions, the water passes out of the showerhead only though a suction outlet baffle and not through said spray ring.

16. A multi-mode showerhead comprising:

a housing having a valve chamber therein, a water inlet and at least one water outlet; and a flow valve located in said valve chamber, said flow valve being rotatable into a plurality of rotative positions, and said flow valve comprising a flow bore therethrough, aid flow bore comprising a flow inlet and a flow outlet;

whereby said showerhead provides a steady unitary stream of water when said flow valve is rotated to a first of said plurality of rotative positions, and a suction action when said flow valve is rotated to a second of said plurality of rotative positions, and whereby when said flow valve is rotated to said first of said plurality of rotative positions, said first flow inlet is in fluid communication with said water inlet and said flow outlet is in fluid communication with a first of said plurality of water outlets; and when said flow valve is rotated to said second of said plurality of rotative positions, said flow inlet is in fluid communication only with a second of said plurality of water outlets.

17. The showerhead as characterized in claim 16, further comprising a spray nozzle through which water is dispersed forming the steady unitary stream of water when said flow valve is rotated to said second of said plurality of rotative positions.

18. The showerhead as characterized in claim 17, further comprising a suction nozzle by which water is passed creating a negative pressure through said suction nozzle creating the suction action when said flow valve is rotated to said second of said plurality of rotative positions, wherein when said flow valve is rotated to said second of said plurality of rotative positions, the water passes out of the showerhead only though a suction outlet baffle and not through said spray nozzle.

19. A multi-mode showerhead comprising:

a housing having a valve chamber therein, a water inlet and a plurality of water outlets;

a flow valve located in said valve chamber, said flow valve being rotatable into a plurality of rotative positions;

a spray ring for forming a spray shower; and a central nozzle that serves as a spray nozzle for forming a steady unitary stream of water and as a suction nozzle for creating a negative pressure through said suction nozzle;

whereby said showerhead provides the spray shower when said flow valve is rotated to a first of said plurality of rotative positions, the steady unitary stream of water when said flow valve is rotated to a second of said plurality of rotative positions, and the suction action when said flow valve is rotated to a third of said plurality of rotative positions, wherein when said flow valve is rotated to said third of said plurality of rotative positions, the water passes out of the showerhead only though a suction outlet baffle and not through said spray ring and said spray nozzle, and wherein said central nozzle is interchangeable (a) so as to have a larger bore to increase the diameter and decrease the pressure of the stream of water through the spray nozzle and to have a smaller bore to decrease the diameter and increase the pressure of the stream of water through the spray nozzle when the showerhead is providing the steady unitary stream of water, and (b) so as to have a larger bore to decrease the negative pressure through the suction nozzle and to have a smaller bore to increase the negative pressure through the suction nozzle when the showerhead is providing the suction action.

* * * * *